US008161785B2

(12) United States Patent
Maine et al.

(10) Patent No.: US 8,161,785 B2
(45) Date of Patent: Apr. 24, 2012

(54) CIRCULAR-SHAPING DEVICE FOR A ROTATING PART, ESPECIALLY AN EXHAUST HOUSING OF A TURBO ENGINE

(75) Inventors: Laurent Maine, Ury (FR); Xavier Denis Jean Marie Olivier, Foucherolles (FR)

(73) Assignee: SNECMA, Paris (FR)

( * ) Notice: Subject to any disclaimer, the term of this patent is extended or adjusted under 35 U.S.C. 154(b) by 814 days.

(21) Appl. No.: 12/238,947

(22) Filed: Sep. 26, 2008

(65) Prior Publication Data

US 2009/0084150 A1 Apr. 2, 2009

(30) Foreign Application Priority Data

Sep. 28, 2007 (FR) ..... 07 57917

(51) Int. Cl.
*B21D 15/00* (2006.01)
*B21D 22/00* (2006.01)
*B21B 38/00* (2006.01)

(52) U.S. Cl. ..... 72/110; 72/31.07; 72/84

(58) Field of Classification Search ..... 72/31.02, 72/31.06, 31.07, 68, 80, 82, 84, 86, 87, 89, 72/91, 110, 111, 112, 125, 365.2; 29/889.2, 29/894.324, 894.35, 894.353, 894.354
See application file for complete search history.

(56) References Cited

U.S. PATENT DOCUMENTS

| | | | | |
|---|---|---|---|---|
| 5,634,361 | A | 6/1997 | Herschman et al. | |
| 6,470,724 | B1 * | 10/2002 | Friese | 72/84 |
| 2004/0035164 | A1 | 2/2004 | Blaser, Jr. | |

FOREIGN PATENT DOCUMENTS

| | | |
|---|---|---|
| JP | 3-19908 | 2/1991 |
| JP | 7-178459 | 7/1995 |

* cited by examiner

*Primary Examiner* — Teresa Ekiert
(74) *Attorney, Agent, or Firm* — Oblon, Spivak, McClelland, Maier & Neustadt, L.L.P.

(57) ABSTRACT

A circular-shaping device for a rotating part, especially an exhaust housing of a turbo engine is disclosed. The device includes a lower unit with two shaping rollers mounted movably along an axis X1 and one shaping roller mounted movably along an axis Y1; an upper unit with two shaping rollers mounted movably along an axis X2 and one shaping roller mounted movably along an axis Y2; a turntable disposed between the lower unit and the upper unit; and a blocking device for the rotating part on the turntable.

9 Claims, 5 Drawing Sheets

CIRCULAR-SHAPING DEVICE FOR A ROTATING PART, ESPECIALLY AN EXHAUST HOUSING OF A TURBO ENGINE

BACKGROUND OF THE INVENTION

The invention relates to a circular-shaping device for a rotating part, especially an exhaust housing of a turbo engine.

DESCRIPTION OF THE PRIOR ART

Turbo engine exhaust housings, especially of turbojet engines, are large-diameter parts made of nickel-based alloy by machine-welding. The welding operations on the housing give rise to multiple deformations. This is why it is necessary to restore the housing to the round state, that is to say to give it back a circular shape before continuing the construction.

These rounding operations are currently carried out by manual smithing with the aid of a hammer. This tedious technique demands skilled labor, calls for numerous working hours, generates noise and causes muscular-skeletal traumas resulting in work stoppages.

SUMMARY OF THE INVENTION

The subject of the invention is specifically a method and a process which eliminate these drawbacks. These objects are achieved, according to the invention, by the fact that the shaping device comprises:

- a lower unit comprising two shaping rollers mounted movably along an axis X1 and one shaping roller mounted movably along an axis Y1;
- an upper unit comprising two shaping rollers mounted movably along an axis X2 and one shaping roller mounted movably along an axis Y2;
- a turntable disposed between the lower unit and the upper unit;
- blocking means for the rotating part on the turntable.

Advantageously, the X1 and Y1 axes on the one hand, and X2 and Y2 axes on the other hand, are coaxial.

The rollers are mounted on force actuators (or cylinders) and exert a stress upon the housing. The cylinders of a same unit exert oppositely directed forces.

By virtue of these characteristics, the inventive shaping device for a rotating part allows the part to be rapidly rounded, while avoiding the working hours necessary according to the prior art.

Advantageously, the lower unit and the upper unit additionally comprise measuring means for the circularity and the diameter of the rotating part.

These means are constituted, for example, by a sensor and by a resistive linear displacement transducer.

Preferably, the transducer is linked to an analog data acquisition board of a numerical control.

In one particular embodiment, the rollers of the upper unit are mounted on a beam mounted such that it can pivot relative to a stand of the device between a first position, in which the rollers are disengaged from the rotating part, and a second position, in which the rollers are engaged on the rotating part.

Advantageously, the blocking means for the rotating part on the turntable are constituted by three quarter-turn clamps and by three blocking cylinders.

The invention additionally relates to a circular-shaping process for a rotating part, especially an exhaust housing, for an aircraft turbojet engine. According to this process

- an operator arranges on a turntable the part to be shaped;
- the operator initiates the work cycle;
- a numerical control clamps the part to the turntable;
- the numerical control sets the turntable in rotation;
- the numerical control measures the mean diameter of the part, as well as the maximum and minimum circularity variances;
- the numerical control determines the position of the shaping rollers as a function of the mean diameter of the part;
- the numerical control places the rollers in the determined position, while continuing to rotate the turntable.

A control cycle for the part is realized after this has been rounded.

A retouching cycle is realized if the control cycle has revealed that the part was out of tolerance.

BRIEF DESCRIPTION OF THE DRAWINGS

Other characteristics and advantages of the invention will also become apparent from a reading of the following description of an exemplary embodiment, given by way of illustration, with reference to the appended figures:

In FIG. 1, the general reference 2 denotes a stand which is static and fixed to the ground. A lower unit, denoted by the general reference 4, is mounted on a lower step 6 of the stand 2. An upper unit, denoted by the general reference 8, is mounted on an upper step 10 of the stand 2. A turntable 12 is mounted on an intermediate step 14 of the stand 2. The turntable 12 supports a rotating part, in the represented example a turbojet exhaust housing for a turbojet engine. The housing comprises a central hub 18 and arm portions 20 connected to the central hub 18. The central hub and the arms 20 are made from a single piece by molding. A case 22 connected to the arms 20 by arm elements 24 constitutes a machine-welded portion of the exhaust housing. As a result of the welding operations, the case 22 undergoes multiple deformations. This is why it is necessary to restore it to the round state. A numerical control is provided in the vicinity of the stand 2. This numerical control traditionally takes the form of a computer linked to the circular-shaping device by a series of interfaces, for example by a logic controller and power relays. Its function is the displaying of data and the controlling of the shaping device as a function of a pre-inputted program.

In FIG. 2, the means for clamping the exhaust housing to the turntable 12 are represented. These means are constituted, on the one hand, by three quarter-turn clamps 26 and, on the other hand, by three clamping cylinders 28 arranged at 120° to one another. The quarter-turn clamps 26 rise pneumatically, then pivot by a quarter turn in order to clamp the exhaust housing 16 to the turntable 12. The quarter-turn clamps and the outer clamping cylinders are positionally controlled by transducers of mechanical limits of travel. The clamping pressure is controlled by two pressure governors ensuring the maintenance of the pressures. The whole of the position data is communicated to the numerical control.

The turntable is set in rotation via a motor 30, the maximum rotation speed of which is, for example, 600 r.p.m. The motor 30 is connected to a 1:10 reducer, which is itself connected to a 1:12 reducer. In this way, the maximum rotation speed of the turntable is 5 r.p.m.

Figure 1:
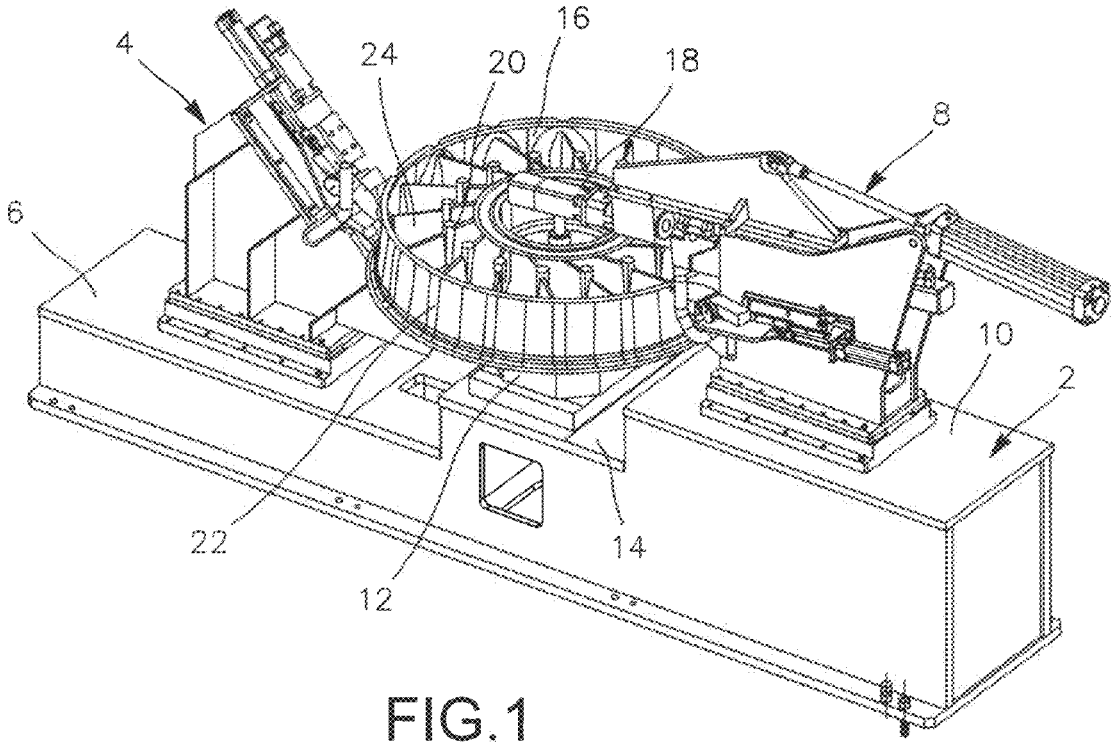
FIG. 1 is a general view in perspective of a shaping device according to the present invention.
Figure 2:
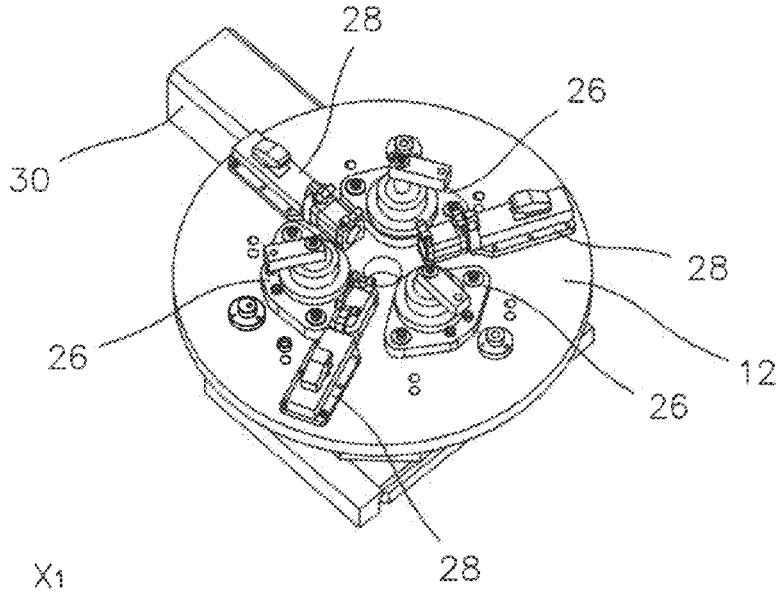
FIG. 2 is a perspective view of the turntable and of the clamping means.
Figure 3:
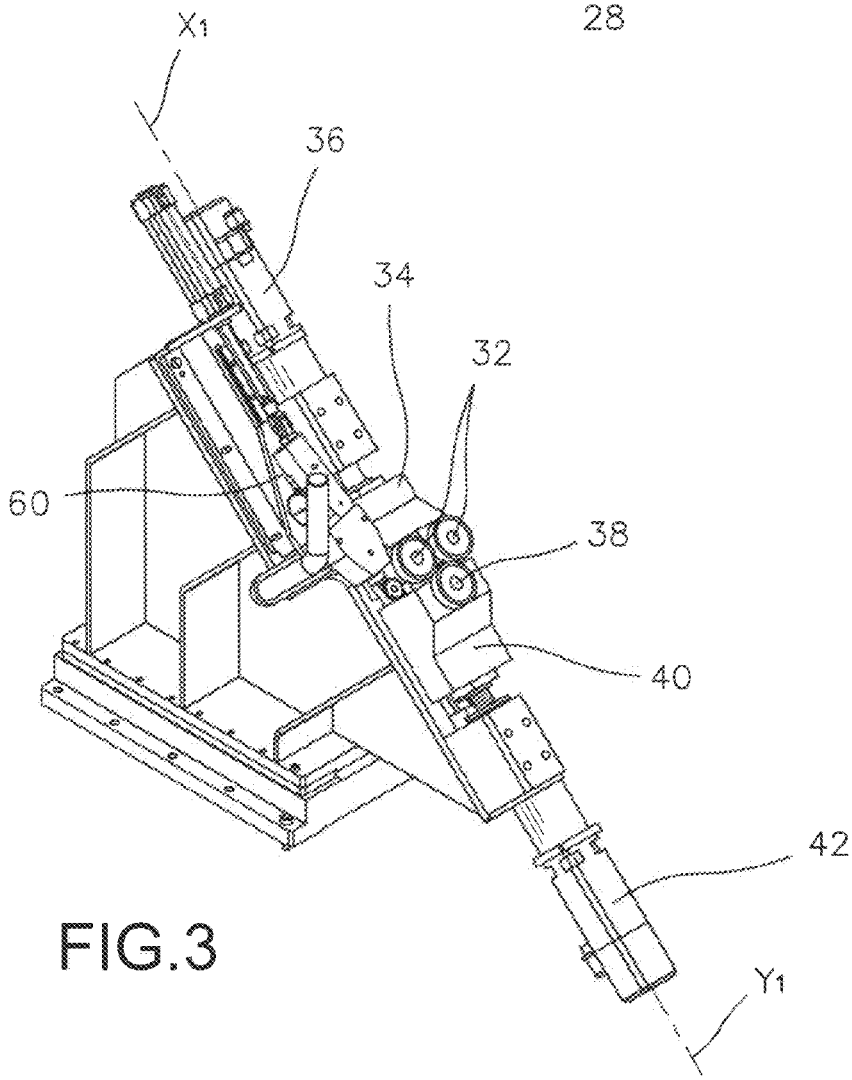
FIG. 3 is a perspective view of the lower unit of the shaping device represented in FIG. 1.

In FIG. 3, a perspective view of the lower unit 4 has been represented. Two rollers 32 are mounted on a mounting 34, which is displaced in translation along an axis X1. The displacement of the mounting 34 is controlled by a geared motor 36, which drives a ball screw. In the example, the diameter of the ball screw is 32 millimeters and its pitch 5 millimeters. By contrast, an inner roller 38 is displaced in translation along an axis Y1. The inner roller 38 is mounted on a mounting 40, the displacement of which is controlled by a geared motor assembly 42. The geared motor 42 drives the displacement of the mounting 40 via a ball screw. In the example, the diameter of the ball screw is 32 millimeters and its pitch 5 millimeters. The whole allows the displacement of the rollers to be adjusted with 1 micrometer precision. Preferably, the axes X1 and Y1 are coaxial.

Figure 4:
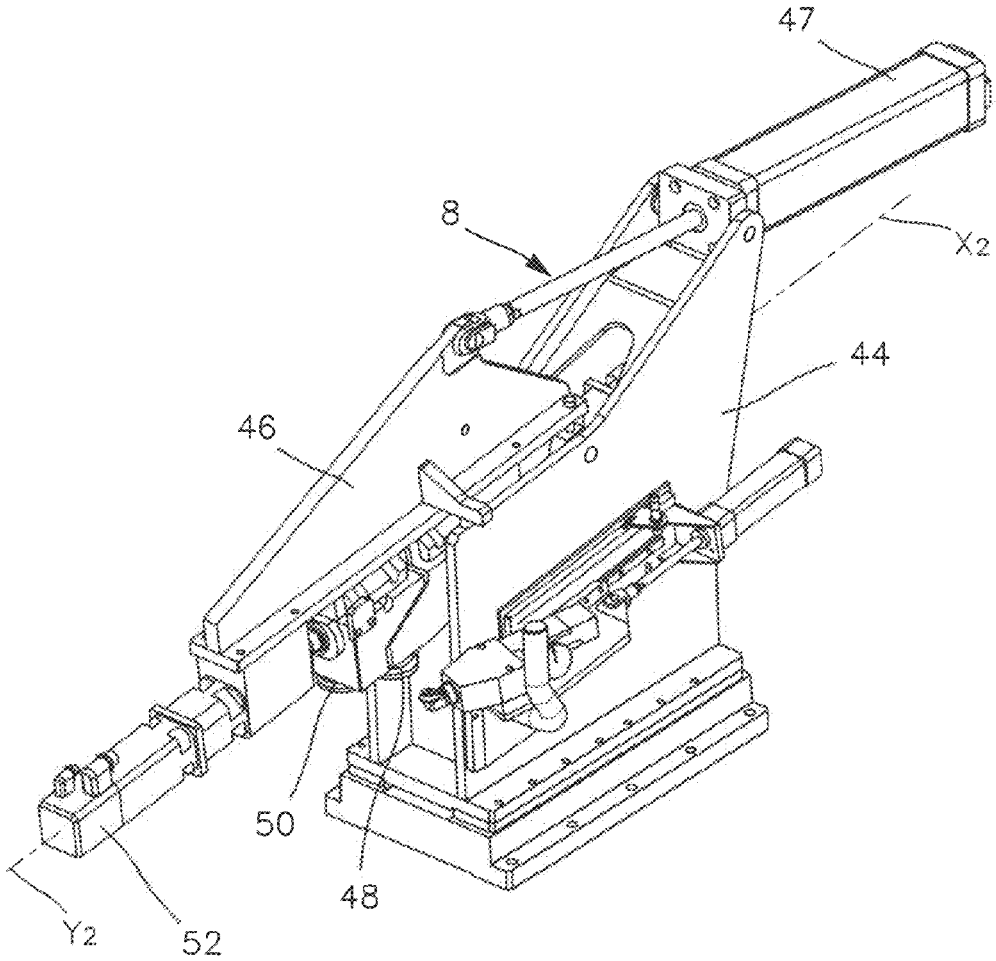
FIG. 4 is a perspective view of the upper unit of the circular-shaping device represented in FIG. 1.

In FIG. 4, a perspective view of the upper unit 8 has been represented. It comprises a mounting 44, on which a beam 46 is pivotably mounted. A cylinder 47 acts upon the beam 46 in order to pivot it. In the same way as the lower unit, the upper unit 8 comprises a first axis X2 and a second axis Y2. In the example, these two axes are coaxial. Two outer rollers 48 (partially visible in FIG. 4) are movable in translation in the direction X2 under the action of a motor driving a ball screw (not visible in the figure). Similarly, an inner roller 50 (partially visible in FIG. 4) is movable in translation along the axis Y2. It is driven by a geared motor 52, acting upon a ball screw. The rollers 48 and 50 are displaced via the tilting cylinder 48 between a first position, in which they are disengaged from the rotating part, and a second position, in which they are engaged on the rotating part.

Figure 5:
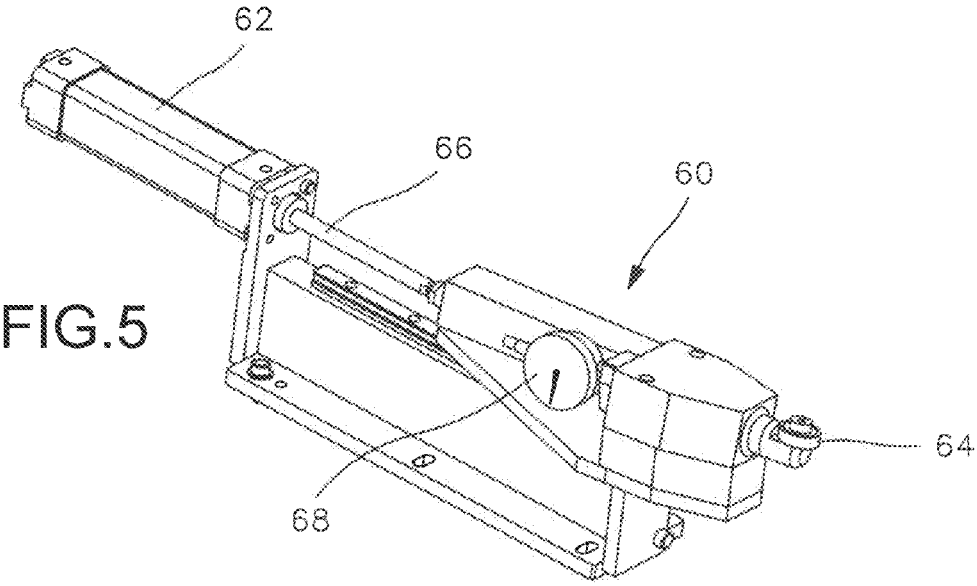
FIG. 5 is a perspective view of a measuring unit forming part of the lower unit.

In FIG. 5, a measuring unit 60 forming part of the lower unit 4 has been represented. This measuring unit comprises a pneumatic positioning cylinder 62. This cylinder provides support to a roller 64 fixedly connected to the cylinder rod 66 on the outer periphery of the rotating part. The measuring unit 60 serves to measure the circularity and the diameter of the part. A measuring transducer is linked to the numerical control. The transducer is constituted by a sensor and by a resistive linear displacement transducer. The latter is linked to an analog acquisition board of the numerical control. A comparator 68 allows a control and a manual adjustment of the unit.

Figure 6:
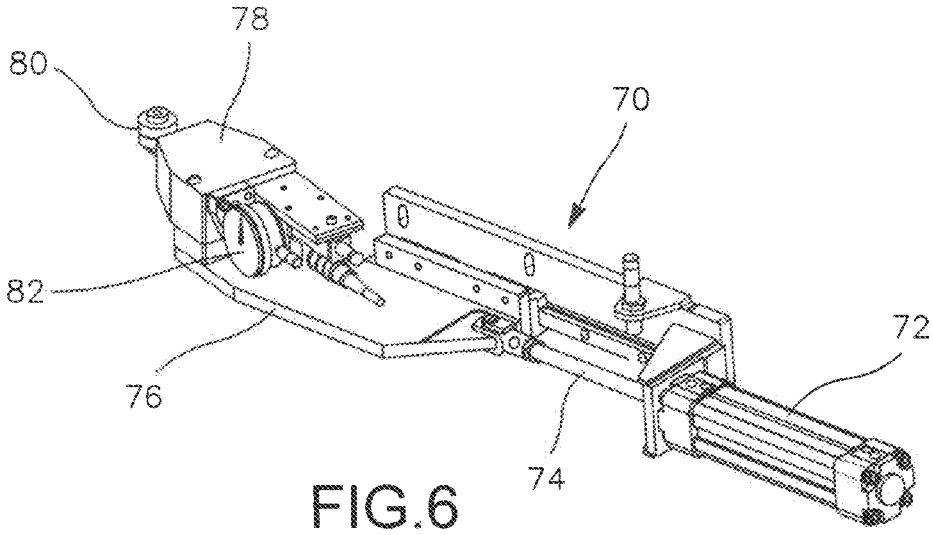
FIG. 6 is a perspective view of a measuring unit forming part of the upper unit represented in FIG. 7.

In FIG. 6, the measuring unit 70 forming part of the upper unit 8 has been represented. This unit is identical in its principle to the measuring unit 60 described with reference to FIG. 5. It comprises a pneumatic cylinder 72, the rod 74 of which is fixedly connected to a mounting 76 on which is mounted the measuring transducer 78. The transducer 78 is constituted by a sensor 80 and a resistive displacement transducer. The latter is linked to an acquisition board of the numerical control.

In the same way as for the measuring unit 60, a comparator 82 allows a control and a manual adjustment of the unit.

Figure 7:
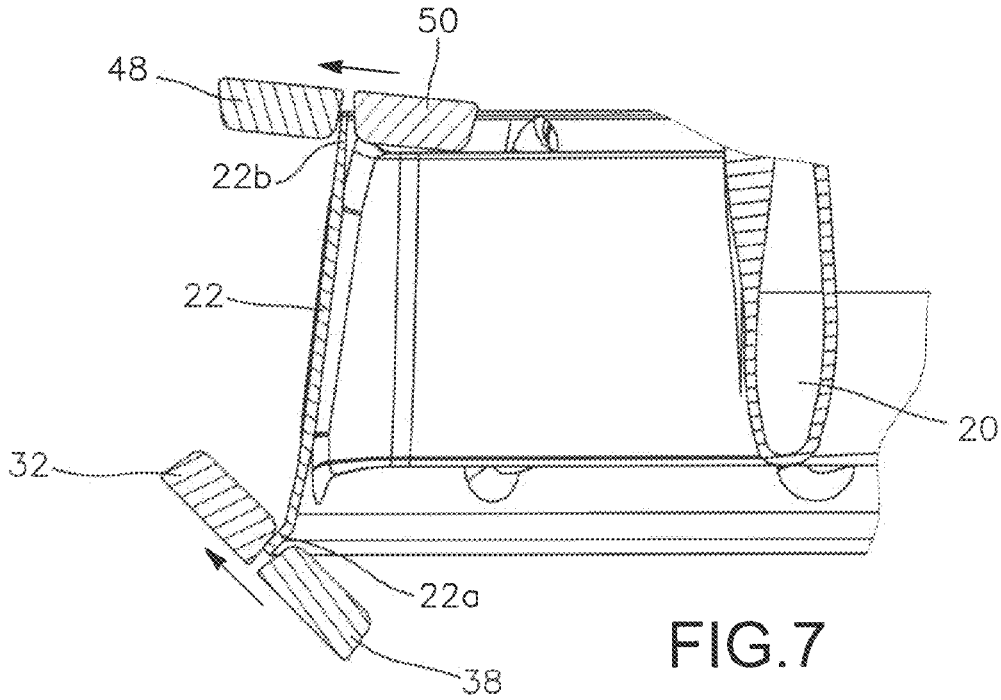
FIG. 7 is a schematic sectional view through an exhaust housing of a turbo engine.
Figure 8:
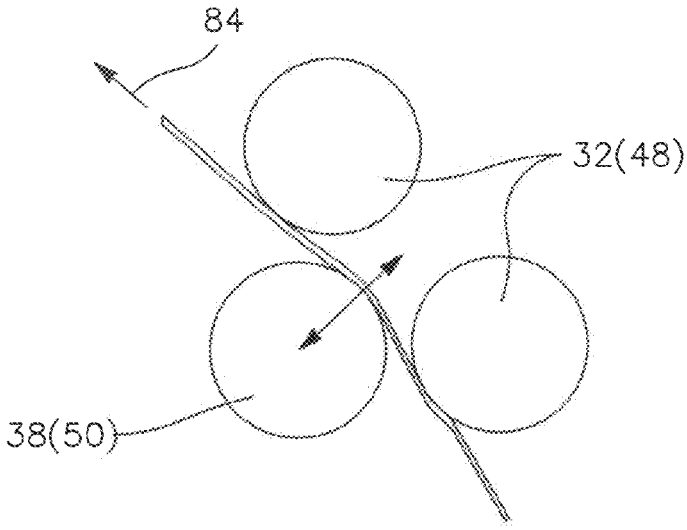
FIG. 8 is a schematic view showing the position of the outer rollers and of the inner roller.

The way in which the case 22 is restored to the round state has been set out in FIGS. 7 and 8. This case 22 comprises a lower part 22*a* and an upper part 22*b*, which are to be made round again. To this end, in a first (optional) step, a map of the deformation of the extremities 22*a* and 22*b* of the case 22 is established. During this step, the mean diameter of the part, as well as the maximum and minimum circularity variances, are measured. The numerical control contains an algorithm which calculates, as a function of the raised deformation, the amount by which the housing needs to be deformed in order to restore it to a circular shape, taking account of the elasticity of the metal. The numerical control places the rollers in the desired position by virtue of the electric geared motor and of the ball screws which allow them to be displaced in translation along the axes X1, Y1, X2 and Y2, as previously explained, while the rotation of the turntable continues. As can be seen more particularly in FIG. 8, there are two outer rollers 32 and 48 respectively, between which there is interposed an inner roller 38 and 50 respectively. The direction of rotation of the part has been schematized by the arrow 84.

Prior to shaping of the part, the deformation is maximally 5 millimeters. Following shaping, it is approximately five-tenths of a millimeter.

The invention claimed is:

1. A circular-shaping device for an exhaust housing of a turbo engine, comprising:

a lower unit comprising two shaping rollers mounted movably along an axis X1 and one shaping roller mounted movably along an axis Y1;

an upper unit comprising two shaping rollers mounted movably along an axis X2 and one shaping roller mounted movably along an axis Y2;

a turntable disposed between the lower unit and the upper unit, the turntable rotating about a vertical axis; and blocking means for the rotating part on the turntable, wherein the axis X1 is not parallel to the axis X2 and not parallel to the vertical axis, and the axis Y1 is not parallel to the axis Y2 and not parallel to the vertical axis.

2. The shaping device as claimed in claim 1, wherein the X1 and Y1 axes are coaxial, and the X2 and Y2 axes are coaxial.

3. The shaping device as claimed in claim 2, wherein, the two shaping rollers of the lower unit mounted movably along the axis X1 are mounted on a first cylinder, the one shaping roller of the lower unit mounted movably along the axis Y1 is mounted on a second cylinder, the two shaping rollers of the upper unit mounted movably along the axis X2 is mounted on a third cylinder, and the one shaping roller of the upper unit mounted movably along the axis Y2 is mounted on a fourth cylinder, such that the rollers exert a stress upon the exhaust housing.

4. The shaping device as claimed in claim 3, wherein the first and second cylinders of the lower unit exert oppositely directed forces, and the third and fourth cylinders of the upper unit exert oppositely directed forces.

5. The shaping device as claimed in one of claims 1 to 4, wherein the lower unit and the upper unit additionally comprise measuring means for the circularity of the rotating part.

6. The shaping device as claimed in claim 5, wherein the measuring means for the circularity of the rotating part are constituted by a sensor and by a resistive or other type of linear displacement transducer.

7. The shaping device as claimed in claim 6, wherein the transducer is linked to an analog data acquisition board of a numerical control.

8. The shaping device as claimed in one of claims 1 to 3, wherein the rollers of the upper unit are mounted on a beam mounted such that the beam can pivot relative to a stand of the device between a first position, in which the rollers are disengaged from the rotating part, and a second position, in which the rollers are engaged on the rotating part.

9. The shaping device as claimed in one of claims 1 to 3, wherein the blocking means for the rotating part on the turntable are constituted by three quarter-turn clamps and by three blocking cylinders.

* * * * *